US006207838B1

(12) United States Patent
Glass et al.

(10) Patent No.: US 6,207,838 B1
(45) Date of Patent: Mar. 27, 2001

(54) ELECTROCHEMICALLY GENERATED ORGANOTHIATING REAGENTS AND THEIR USE

(75) Inventors: Richard S. Glass; Viatcheslav V. Jouikov, both of Tucson, AZ (US)

(73) Assignee: The University of Arizona, Tucson, AZ (US)

( * ) Notice: Subject to any disclaimer, the term of this patent is extended or adjusted under 35 U.S.C. 154(b) by 0 days.

(21) Appl. No.: 09/302,908

(22) Filed: Apr. 30, 1999

(51) Int. Cl.[7] ..... C07D 333/32; C07C 319/00; C25B 3/00

(52) U.S. Cl. ..... 549/62; 568/38; 568/54; 568/58; 205/422; 205/431; 205/444

(58) Field of Search ..... 205/422, 431, 205/444; 549/62; 568/38, 58, 54

(56) References Cited

U.S. PATENT DOCUMENTS

| | | | |
|---|---|---|---|
| Re. 31,771 | 12/1984 | McKinnie et al. | 568/54 |
| 1,940,757 | 12/1933 | Lehmann et al. | 8/5 |
| 3,406,202 | 10/1968 | Reifschneider et al. | 260/578 |
| 3,920,444 | 11/1975 | Harrington et al. | 71/103 |
| 4,146,688 | 3/1979 | Schwindt et al. | 521/159 |
| 4,324,920 | 4/1982 | McKinnie et al. | 568/54 |
| 4,594,453 | 6/1986 | Ranken et al. | 564/440 |
| 4,595,742 | 6/1986 | Nalepa et al. | 528/64 |
| 4,670,597 | 6/1987 | Ranken et al. | 564/440 |
| 4,670,598 | 6/1987 | Davis | 564/440 |
| 4,760,188 | 7/1988 | Ranken et al. | 564/440 |
| 4,866,209 | 9/1989 | Ranken et al. | 564/440 |
| 4,889,955 | 12/1989 | Ranken | 564/440 |
| 4,982,002 | 1/1991 | McKinnie et al. | 564/440 |
| 5,534,036 | 7/1996 | Junino et al. | 8/411 |

FOREIGN PATENT DOCUMENTS

| | | |
|---|---|---|
| 0591059 | 4/1994 | (EP) . |
| 59-42346 | 3/1984 | (JP) . |

OTHER PUBLICATIONS

Michael Dietrich et al., "On the Determination of Redox Potentials of Highly Reactive Aromatic Mono– and Multications", J of Am. Chem. Soc., vol. 112, 1990, pp. 5142–5145. No Month Available.

Quang Tho Do et al., "Electrophillic substitutions with the electrogenerated sulfenium cation $R^0S^+$", Tetrahedron Letters, vol. 39, 1998, pp. 4657–4658. No Month Available.

Charles M. Buess et al., "Derivatives of Sulfenic Acids. IV. The Reaction of 2,4–Dinitrobenzenesulfenyl Chloride with Aromatic Systems", J. Of Am. Chem. Soc. vol. 72, 1950, pp. 3529–3532. No Month Available.

Herbert Brintzinger et al., "Reaktionen mit Chlormethylschwefelchlorid, II. Mitteilung", Chemische Berichte, vol. 85, 1952, pp. 338–343 not translated. No Month Available.

Herbert Brintzinger et al., Synthesen mit Alkylschwefelchloriden (X. Mitteil.) über organische Schwefelchloride), Chemische Berichte vol. 87, 1954 pp. 325–330 not translated. No Month Available.

Norman Kharasch et al., "Derivatives of Sulfenic Acids. XV. A New Synthesis of Thiophenols", J. Of Organic Chem., vol. 19, 1954, pp. 1704–1707. No Month Available.

Robert D. Schuetz et al., "A New Synthesis of Thiophene– and Thianaphthenethiols", J of Organic Chem., vol. 27, 1962, pp. 1301–1304. No Month Available.

CAPLUS Abstract of Barton et al., Tetrahedron Lett., 1993, 34(12), pp. 1871–1874, (2 pages). No Month Available.

Basil S. Farah et al., "Alkylmercaptophenols by Sulfenylation of Phenols", Journal of Organic Chemistry, vol. 28, 1963, pp. 2807–2809. No Month Available.

Paul F. Ranken et al., "Alkylthio Aromatic Amines", Journal of Organic Chemistry, vol. 54, 1989, pp. 2985–2988. No Month Available.

Douglas W. Grant et al., "Lewis Acid–catalysed Sulphenylations of Methylbenzenes by p–Chlorobenzenesulphenyl Chloride", Journal of Chemical Research (S), 1987, pp. 392–393, No Month Available.

R.T. Wragg, "The Synthesis of Alkyl p–Hydroxyphenyl Sulphides", Journal of the Chemical Society, 1964, pp. 5482–8483. No Month Available.

Elizabeth A. Gray et al., "Pyrimidines. Part III.[1] Synthesis of Some 5–Alkythiopyrimidines", Journal of the Chemical Society (C), 1970, pp. 986–989. No Month Available.

George R. Brown et al., "Sulphides, Sulphoxides, and Sulphones derived from Salicylic Acids", Journal of the Chemical Society, Perkins Transactions, I, 1978, pp. 633–638. No Month Available.

Giuseppe Capozzi et al., "Reactions of Sulphenyl Chlorides and Disulphides in Acidic Media. Trapping of Alkyl(bis-alkylthio)sulphonium Ion Intermediates" Journal of Chemical Society, Perkins Transactions, II, 1975, pp. 900–903. No Month Available.

Helmuth M. Gilow et al., "Sulfenylation of Some Pyrroles and Indoles", Journal of Heterocyclic Chemistry, vol. 28, 1991 pp. 1025–1034. No Month Available.

Alain Goux et al., "Liquid–phase alkylthiolation reaction of phenol by dimethyldisulfide over zeolites", Journal of Molecular Catalysis, vol. 89, 1994, No Month Available, pp. 383–390.

Kimihisa Yamamoto et al., "Anodic Oxidation of Diphenyl Disulfides for Preparation of Oligo(p–phenylene sulfide)s in Acidic Media", Journal of Electeochemical Society, vol. 139, No. 9, 1992, pp. 2401–2406. No Month Available.

(List continued on next page.)

*Primary Examiner*—Edna Wong
(74) *Attorney, Agent, or Firm*—E. E. Spielman, Jr.

(57) ABSTRACT

Electrolysis of organic disulfides in liquid sulfur dioxide is used to obtain organothiating agents, which can then be reacted with appropriate substrates to effect the synthesis of organothioaromatic compounds efficiently and in high yields. With appropriate phenolic compounds, regioselective substitution occurs in which para substitution greatly exceeds ortho substitution.

19 Claims, No Drawings

OTHER PUBLICATIONS

J. H. Verheijen et al., "Improved Synthesis of Benzo–1, 4–dithiin and of Benzo–1,4–oxathiin", Synthesis, 1975, pp. 451–452. No Month Available.

Paul F. Ranken et al., "Alkylthiolation of Phenols", Synthesis, 1984, pp. 117–119. No Month Available.

Tamotsu Fujisawa et al., "Iron–Catalyzed Aromatic Sulfuration with Sulfenyl Clorides", Tetrahedron Letters, No. 49, 1968, pp. 5071–5074. No Month Available.

Tamotsu Fujisawa et al., "Ortho Effect of the Nitro Group on Iron–Catalyzed Aromatic Sulfuration With Substituted Benzenethiosulfenyl Chlorides", Tetrahedron Letters, No. 49, 1969, pp. 4291–4294, No Month Available.

T.C. Waddington, ed., "Non–Aqueous Solvent Systems", 1965, New York: Academic Press, Chapter 6, pp. 253–284. No Month Available.

J.K. Bosscher et al., "Electrophilic Methylthiolation and Arylthiolation of Aromatic Compounds with Thiosulphonates", Chemical Communications, 1971, No Month Available, p. 1365.

Alan Bewick et al., "Anodic Acetamidosulphenylation of Alkenes via Anodic Oxidation of Disulfides", Journal of the Chemical Society, Perkins Transactions, Part 1, 1985, pp. 1033–1038, No Month Available.

Driss Elothmani et al., "Anodic Oxidation of Di–tert–butyl Disulfide: a Facile Method for the Preparation of N–tert–Butylamides", Chemical Society, Chemical Communications, 1993, pp. 715–717. No Month Available.

Giuseppe Capozzi, "Methyl(bismethylthio)sulphonium salts and trimethylsilyl–suphenyl halides as synthons in organo–sulphur chemistry", Pure & Applied Chemistry, vol. 59, No. 8, 1987, pp. 989–992. No Month Available.

Marsaru Hojo et al., "Silica Gel as a Catalyst for the Condensations of Aromatic Compounds with RSC1, $RSCH_2C1$, and $S_2C1_2$", Synthetic Communications, vol. 5, No. 3, 1975, pp. 173–176. No Month Available.

Kimihisa Yamamoto et al., "Electroactive Poly(Arylene Sulphide) Electro–Oxidative Polymerization of 3,5–Dimethylthiophenol" European Polymer Journal, vol. 28, No. 4, 1992, pp. 341–346. No Month Available.

ELECTROCHEMICALLY GENERATED ORGANOTHIATING REAGENTS AND THEIR USE

TECHNICAL FIELD

This invention relates to electrochemical generation of organothiating agents, which may then be reacted with appropriate substrates to effect the synthesis of organothioaromatic compounds.

BACKGROUND

Electrophilic thiation is typically accomplished by the use of a sulfenyl chloride, disulfide, or thiosulfonate, with a Lewis or Bronsted acid. Silica gel has been used to catalyze the reactions of sulfenyl chlorides with arenes, while zeolites have been used for catalysis of hydrocarbyl disulfide reactions with aromatic alcohols. A method has also been reported for thiation using electrochemically generated sulfenium ion in dichloromethane, with low yields; see Do et al., *Tetrahedron Lett.,* 1998, 4657. Electrochemical preparation of organothiating agents is desirable because organothiation can be achieved in the absence of a Lewis acid catalyst; high yields of organothiated products are also desirable.

THE INVENTION

This invention provides for the electrochemical generation of organothiating species from organic disulfides ($R_2S_2$) in liquid sulfur dioxide, and further provides for the reaction of the organothiating species thus generated with appropriate substrates to effect the synthesis of organothioaromatic compounds. Because the organothiating agent is generated electrochemically, no catalyst is required; the absence of a catalyst minimizes the formation of side products. Moreover, the process of the invention provides organothiated products in high yield. Another advantageous feature of this invention is that it enables the organothiation of strongly to weakly activated aromatic compounds in high yield. In fact, when the substrate is a phenol, a high yield of the para-organothiated product is obtained, even though no catalyst, much less a para-directing catalyst, is used in the process. In short, this invention makes possible non-catalytic regioselective organothiation in a wide variety of aromatic compounds.

Thus, in accordance with one of the embodiments of this invention, there is provided a process for generating an organothiating agent in liquid sulfur dioxide via electrolysis of an organic disulfide, such as an alkyl disulfide, in which the organic groups are free of nonaromatic unsaturation.

Another embodiment of the invention is a process which comprises generating an organothiating agent in liquid sulfur dioxide via electrolysis of an organic disulfide in which the organic groups are free of nonaromatic unsaturation, and contacting all or a portion of the resultant solution from the electrolysis with an organothiatable substrate. In this way, a wide variety of useful organothiated aromatic compounds can be produced with high efficiency and in high yield.

These and other embodiments and features of this invention will be apparent from the ensuing description and appended claims.

The organic disulfides utilized in the practice of this invention can be represented by the formula R—S—S—R where R is the organic group, each of which typically contains no more than about 24 carbon atoms. Although there are two organic groups in the molecule, when the organic groups are the same, such compounds are often named, for example, as methyl disulfide instead of dimethyl disulfide. The organic groups of the organic disulfides utilized in the practice of this invention can be hydrocarbyl groups (i.e., the organic groups consist of carbon and hydrogen), or they can be functionally substituted hydrocarbyl groups wherein the substituent(s) on the hydrocarbyl group are innocuous in the sense that they do not materially interfere with the formation of the organothiating agent. Tertiary hydrocarbyl disulfides are not desired as organic disulfides in this invention because they do not generate thiating agents; see Elothmani et al., *J. Chem. Soc., Chem. Comm.,* 1993, 715. Because alkenes are known to react with thiating agents, nonaromatic unsaturation is also undesirable in the organic disulfide. Preferably, the organic disulfide used is a hydrocarbyl disulfide.

The hydrocarbyl groups of the disulfides used in the practice of this invention can be primary or secondary aliphatic, cycloaliphatic, or aromatic hydrocarbyl groups. Of such hydrocarbyl disulfides, preferred are the primary aliphatic disulfides. The aliphatic hydrocarbyl groups can be linear or branched. Preferably, the hydrocarbyl groups will each contain up to about 18 carbon atoms, and more preferably, up to about 8 carbon atoms.

The organic disulfides in which the organic groups contain one or more innocuous functional substituents are compounds in which the substituents are, for example, halogen atoms, alkoxy groups, aryloxy groups, nitro groups, esterified carboxyl groups, nitrile groups, heterocyclic groups in which the heteroatom(s) is/are oxygen, and the like.

Examples of suitable organic disulfides include methyl disulfide, ethyl disulfide, 2-hydroxyethyl disulfide, propyl disulfide, 3-carboxypropyl disulfide, isopropyl disulfide, n-butyl disulfide, sec-butyl disulfide, 2,2,4,4-tetramethylcyclobutyl disulfide, heptafluorocyclobutyl disulfide, pentyl disulfide, cyclopentyl disulfide, cyclohexyl disulfide, cyclooctyl disulfide, 2-methylphenyl disulfide, 4-methylphenyl disulfide, 3-nitrophenyl disulfide, 1-naphthyl disulfide, 2-naphthyl disulfide, and the like. Preferred hydrocarbyl disulfides are the primary aliphatic disulfides, $RCH_2$—S—S—$CH_2R$, where R is a hydrocarbyl group, preferably having up to about 17 carbon atoms. Particularly preferred hydrocarbyl disulfides are methyl disulfide and ethyl disulfide, especially methyl disulfide.

The electrolysis of the organic disulfide can be carried out in a two-compartment electrochemical cell by passing current through the electrochemical cell in the presence of the organic disulfide and a supporting electrolyte. The supporting electrolyte may be any salt that is soluble in liquid sulfur dioxide, not redox active in the potential range used, and unreactive toward the electrolysis products. Particularly preferred supporting electrolytes are salts of the tetra(n-butyl)ammonium cation, especially the tetrafluoroborate salt, and more particularly the hexafluorophosphate salt.

Because the electrolysis is carried out in liquid sulfur dioxide, the electrochemical cell is usually maintained at conditions such that sulfur dioxide is a liquid. At atmospheric pressure, this condition is satisfied when the temperature is in the range of from about −73° C. to about −10° C. A preferable temperature at atmospheric pressure is in the range of from about −60° C. to about −10° C.; more preferred temperatures are in the range from about 45° C. to about −10° C. It is preferred to conduct the electrolysis at atmospheric pressure rather than under either increased or reduced pressure. However, in the event it is desired pursuant to this invention to operate at temperatures above −10° C a suitable pressure is applied to the electrolysis system so as to keep the sulfur dioxide in a liquid state of aggregation. The desirability of performing this pressurized embodiment of this invention will at least to some extent be governed by the relative costs of pressurized equipment and operation as compared to refrigeration equipment and operation.

The electrolysis may be carried out under constant current or constant potential with the potential maintained in a range from about 0.5V less than the oxidation potential of the organic disulfide to about 1.0 V more than the oxidation potential of the organic disulfide. Preferably, the potential is in a range of from about 0.3 V less than the oxidation potential of the organic disulfide to about 0.5V more than the oxidation potential of the organic disulfide. Actual potential values will vary, depending on the redox potential of the chosen organic disulfide and choice of reference electrode. The current passed during the electrolysis corresponds to the amount of electricity in the range of from about 90000 Coulombs to about 205000 Coulombs per mole of organic disulfide. A preferred range is from about 187000 Coulombs to about 197000 Coulombs per mole of organic disulfide. Variations from these ranges are possible in the practice of this invention, as deemed necessary by those skilled in the art.

A wide variety of aromatic compounds are suitable as organothiatable substrates, provided that the site to be organothiated has a hydrogen atom as its substituent, and that other substituents, if any, present in the compound do not interfere with the desired reaction. The aromatic compounds may be heterocyclic systems such as those containing oxygen or sulfur, and/or fused ring systems. Examples of homocyclic aromatic compounds which should be suitable for use in the process include benzene, naphthalene, anthracene, phenanthrene, indene, isoindene, fluorene, chrysene, pyrene, triphenylene, toluene, xylene, biphenyl, and similar compounds. Suitable heterocyclic aromatic compounds include thiophene, thionaphthalene, xanthene, thioxanthene, thianthrene, furan, benzofuran, isobenzofuran, and the like.

Examples of substituents (other than hydrogen atoms) which may be present on the aromatic ring include, but are not limited to, hydroxy groups, hydrocarbyl groups, and hydrocarbyloxy groups. Aromatic rings containing only deactivating (and hydrogen atom) substituents are not expected to react with an organothiating agent. Deactivating substituents, such as nitro groups and carboxyl groups, may be present under one of the following two conditions: first, when an activating substituent is also present on the aromatic ring to be organothiated, as in, for example, p-nitrophenol or 2-methyl-3-nitronaphthalene; second, when reaction with a different aromatic ring is desired, for a compound with two or more aromatic rings, as in, for example, 3-nitrofluorene. Substituted homocyclic aromatic compounds that may be used include methoxybenzene, thioanisole, acenaphthene, 2-isopentoxynaphthalene, 7-isopropyl-1-methylphenanthrene, 3-methylindene, 1,2-diphenylindene, 5,6-dimethylchrysene, 2,7-dimethylpyrene, 1-acetylpyrene, 1,3-dimethylanthracene, 9,10-dibenzylanthracene, 4,4'-dimethoxybiphenyl, 2,4'-diethoxy-3,3 '-dimetylbiphenyl, and the like. Substituted heterocyclic aromatic compounds include, for example, 2-octylthiophene, 9-phenyl-xanthene, 2-benzoylbenzofuran, 2-tert-butylfuran, 2,5-dimethoxyfuran, and similar compounds. Typically, the aromatic compound used as the substrate will contain up to about 40 carbon atoms.

Preferred aromatic compounds for use as the organothiatable substrate are those with one or more hydroxy substituents, especially hydroxy aromatic compounds having a para position available for thiation. Such compounds, even where one or more other positions, such as an ortho position, are also available for thiation, have a marked tendency to become organothiated in the para position. Suitable substituted aromatic alcohols are, for example, 4-methoxy-1-hydroxynaphthalene, 1,6-dinitro-2-hydroxynaphthalene, 2,2'-dihydroxy-6,6'-dimethylbiphenyl, 2-hydroxy-2'-methoxy-5,5'dimethylbiphenyl, 1-hydroxy-3-acetylnaphthalene, and 2-hydroxy-5-methylthiophene. More preferred as the organothiatable substrate are unsubstituted aromatic alcohols. Examples of unsubstituted aromatic alcohols are phenol, 1,3-dihydroxybenzene, catechol, resorcinol, hydroquinone, 1,2,4,5-tetrahydroxybenzene, 1-hydroxynaphthalene, 2-hydroxynaphthalene, 1,8-dihydroxynaphthalene, 1,2,3,4-tetrahydroxynaphthalene, 2-hydroxyfluorene, 9-hydroxyphenanthrene, 3,4-dihydroxyphenanthrene, 3,4,5-trihydroxyphenanthrene, 1-hydroxyanthracene, 2,6-dihydroxyanthracene, 1,5,9-trihydroxyanthracene, 3,4-dihydroxybiphenyl, 2,2',4,4'-tetrahydroxybiphenyl, 2-hydroxythiophene, 9-hydroxyxanthene, 4,4'-dihydroxydiphenyl, 4,4'-methylenebisphenol, bisphenol-A, and similar phenolic compounds. Highly preferred substituted aromatic alcohols are hydrocarbyl substituted phenols, especially $C_1$–$C_8$ monoalkyl substituted phenols, especially where the alkyl substituent is in the ortho or para position. The most preferred unsubstituted aromatic alcohol is phenol.

Variations are possible in the proportions in which the disulfide and the aromatic substrate are used in the organothiation reaction. Each mole of organothiating reagent has in theory the capability of organothiating one organothiatable site in one mole of the substrate. Thus, in situations where there is only one organothiatable site in the substrate, or where the substrate has more than one organothiatable site and all such sites are to be organothiated, the relative proportions of organothiating reagent (and thus original disulfide) and of the substrate can be widely varied from a stoichiometric deficiency of organothiating reagent to a stoichiometric excess of organothiating reagent relative to the substrate. To minimize the amounts of unreacted reagent to be separated from the organothiated product (when such separation is desired), the organothiating reagent and such substrate are preferably mixed together in approximately stoichiometric proportions so that the conversion of both reactants to desired product is essentially complete.

When the substrate contains a plurality of organothiatable sites, but less than all are to organothiated, it is desirable to employ an amount of organothiating reagent that is somewhat less than, equivalent to, or only slightly more than the stoichiometric amount required to effect the extent of organothiation desired. For example, when more than one organothiatable site is present in the substrate, and mono-organothiation is desired, amounts of organothiating reagent (and thus of original disulfide) below one mole per mole of substrate can be used, although it is usually preferable to use approximately one mole of organothiating reagent per mole of such substrate. But when more than two organothiatable sites are present in the substrate, and di-organothiation is desired, the preferred amount of organothiating reagent (and thus of original disulfide) is approximately two moles per mole of such substrate. However, if using less than two moles of organothiating reagent in such a situation, at least an amount above one mole of organothiating reagent should be used per mole of the such substrate to ensure that at least some di-organothiated product will be produced. Thus in general, when the number of organothiatable sites is greater than the number of sites that are intended to be organothiated, amounts of organothiating reagent (and thus the amount of original disulfide) used should be such as to provide a sufficient conversion to the desired product without producing an undesirable amount of unwanted by-products. However, while not a preferred embodiment of this invention, under some circumstances, a mixture of products may be desired, and in such case the proportions are adjusted accordingly. The most preferred proportion used is about one mole of organothiating reagent per mole of sites to be organothiated.

The organothiation should be conducted under inert conditions, generally meant to signify the absence of water and oxygen, and usually includes the use of an inert gas such as, for example, helium, argon, or nitrogen. Because the organothiation occurs in the presence of liquid sulfur dioxide, the temperature range must again be such that the sulfur dioxide is a liquid. A highly preferred temperature range for the organothiation at atmospheric pressure is from about −25° C. to about −10° C. Again, atmospheric pressure is a preferred condition under which to conduct the process. The presence of a solvent other than liquid sulfur dioxide is not necessary, but if another solvent is used, it should also be oxygen- and water-free and not interfere with the organothiation reaction.

The electrolyzed hydrocarbyl disulfide solution (or a portion thereof), comprising the organothiating agent, and the organothiatable substrate may be added to each other in any order. If the hydrocarbyl disulfide and the substrate are contacted in the electrochemical cell, the electrolysis should already be complete, as the potential range used in the electrolysis will typically also oxidize the products of the organothiation. It is preferred to contact the organothiating agent and the organothiatable substrate in a different vessel; more preferably, the electrolyzed hydrocarbyl disulfide solution is added to the organothiatable substrate.

The sulfur dioxide solvent may be recycled. It may be kept in the liquid state, or by allowing it to warm to a temperature above −10° C. (at atmospheric pressure), it may be handled in the gaseous state. It is preferred to recycle the sulfur dioxide after the organothiation step, when an organothiation step is done.

A preferred embodiment of the invention is the electrolysis of a primary aliphatic hydrocarbyl disulfide in liquid sulfur dioxide at atmospheric pressure in a temperature range from about −73° C. to about −10° C. (more preferably in the range of about −60° C. to −10° C.) in a two-compartment electrochemical cell. It is further preferred to remove the electrolyzed solution of the primary aliphatic hydrocarbyl disulfide from the electrochemical cell and add it to a vessel containing an aromatic alcohol, with the temperature in the range of from about −60° C. to about −10° C. at atmospheric pressure. It is within the scope of this invention to transfer the electrolyzed solution from the electrochemical cell to the foregoing vessel while maintaining a superatmospheric pressure upon the contents being transferred so as to maintain the sulfur dioxide in the liquid state. In such a pressurized operation the temperature can be above −10° C.

A highly preferred embodiment of the invention is the electrolysis of methyl disulfide in liquid sulfur dioxide at atmospheric pressure in a temperature range from about −60° C. to about −10° C. (more preferably from about 45° C. to about −10° C.) in a two-compartment electrochemical cell, and to remove the electrolyzed solution of methyl disulfide from the electrochemical cell and add it to a vessel containing a mononuclear phenol (most preferably phenol itself), with the temperature in the range of from about −60° C. to about −10° C. (more preferably from about −25° C. to about −10° C.) at atmospheric pressure. As pointed out above, the temperatures in either or both of the electrochemical cell and the receiving vessel can be above −10° C. if, pursuant to this invention, a superatmospheric pressure is imposed thereon.

The following examples are presented for purposes of illustration, and are not intended to impose limitations on the scope of this invention. For all of the examples, a specially designed system was used, which consists of a drying and condensing line and a two-compartment electrochemical cell. The working electrode (anode) was a platinum gauze cylinder 50 mm in height and 10 mm in diameter; the auxiliary electrode (cathode) was an aluminum cylinder with a total area of 100 $cm^2$; a silver wire was used as the reference electrode. Both compartments of the electrochemical cell contained 1.5 g (4 mmol) of $(n\text{-}Bu)_4NPF_6$ as the supporting electrolyte. The system was purged with argon prior to the electrolysis. Sulfur dioxide was passed through a column packed with activated alumina, condensed in a trap cooled with 2-propanol/dry ice, and poured into the electrochemical cell when 30 mL had been collected in the trap. Once the supporting electrolyte has dissolved, the hydrocarbyl disulfide is added to the anodic chamber of the electrochemical cell via syringe. The temperature of the electrochemical cell is maintained between −45° C. and −35° C., and both chambers of the electrochemical cell are stirred during the electrolysis. After 193000 Coulombs (2F) per mole of hydrocarbyl disulfide are passed at the working electrode while varying the potential between 0.6V and 1.4V, the electrolysis is stopped, and the solution in the anodic chamber is transferred to a flask containing the desired organothiatable substrate.

EXAMPLE 1

Dimethyldisulfide (0.3 g 3.2 mmol) is the hydrocarbyl disulfide; the anodic chamber solution is added to anthracene (0.57 g, 3.2 mmol) under a blanket of argon. The reaction mixture is stirred at −15° C. for three hours, after which the solution is allowed to warm to room temperature, evaporating the sulfur dioxide. The solid thereby obtained is dissolved in 10 mL of dichloromethane, and 25 mL diethyl ether is added to precipitate the supporting electrolyte. After separation of the precipitate, the solvent is evaporated, and the yellow solid is dissolved in 10 mL of ethyl acetate and precipitated by the addition of 15 mL of methanol. The yield of 9-(methylthio)anthracene is 78%.

EXAMPLE 2

The procedure of Example 1 is followed, except for the following: thioanisole (0.396 g, 3.2 mmol) is the organothiatable substrate; the product is extracted from the solid obtained after the evaporation of sulfur dioxide using two 10 mL portions of diethyl ether; the portions are combined, along with the unreacted thioanisole, and the solvent is removed using a rotary evaporator. The yield of 1,4-di (methylthio)benzene is 68%, based on reacted thioanisole.

EXAMPLE 3

The procedure of Example 1 is followed, except for the following: p-xylene (0.34 g, 3.2 mmol) is the organothiatable substrate; and, after separation of the precipitated supporting electrolyte, the mixture is chromatagraphed on silica gel using a 5:1 hexanes:dichloromethane solvent mixture as the eluent. The yield of 1,4-dimethyl-2-(methylthio) benzene is 60%, and the yield of 1,4-dimethyl-2,5-di (methylthio)benzene is 26%, as determined by gas chromatography.

EXAMPLE 4

The procedure of Example 3 is followed, except for the following: phenol (0.3 g, 3.2 mmol) is the organothiatable substrate, and the eluent is a 1:1 hexanes:dichloromethane solvent mixture. The yield of o-(methylthio)phenol is 9.5%, and the yield of p-(methylthio)phenol is 83%, as determined by gas chromatography.

EXAMPLE 5

The procedure of Example 4 is followed, except that 3,5-dimethylphenol (0.39 g, 3.2 mmol) is the organothiatable substrate. The yield of 2-methylthio-3,5-dimethylphenol is 99%, based on reacted 3,5-dimethylphenol.

EXAMPLE 6

The procedure of Example 3 is followed, except that thiophene (0.126 g, 1.5 mmol) is the organothiatable substrate. The yield of 2,5-di(methylthio)thiophene is 57%.

EXAMPLE 7

The procedure of Example 4 is followed, except that 1,2,3-trimethoxybenzene (0.25 g, 1.5 mmol) is the organothiatable substrate. The yield of 1,2,3-trimethoxy-5-(methylthio)benzene is 53%, as determined by gas chromatography.

EXAMPLE 8

The procedure of Example 4 is followed, except that diphenyl ether (0.255 g, 1.5 mmol) is the organothiatable substrate. The yield of p-(methylthio)phenyl phenyl ether is 49%; the yield of bis[p-(methylthio)phenyl] ether is 9%.

EXAMPLE 9

The procedure of Example 4 is followed, except that methoxybenzene (0.16 g, 1.5 mmol) is the organothiatable substrate. The yield of p-(methylthio)methoxybenzene is 82%, as determined by gas chromatography.

The following Table summarizes the results of the organothiations from the examples.

TABLE

| Ex. # | starting material | product | yield |
|---|---|---|---|
| 1 | anthracene | 9-(methylthio)anthracene | 78% |
| 2 | thioanisole | 1,4-di(methylthio)benzene | 68% |
| 3 | p-xylene | 1,4-dimethyl-2-(methylthio)-benzene | 60% |
| | | 1,4-dimethyl-2,5-di(methylthio)-benzene | 26% |
| 4 | phenol | o-(methylthio)phenol | 9.5% |
| | | p-(methylthio)phenol | 83% |
| 5 | 3,5-dimethylphenol | 2-methylthio-3,5-dimethylphenol | 99% |
| 6 | thiophene | 2,5-di(methylthio)thiophene | 57% |
| 7 | 1,2,3-trimethoxybenzene | 1,2,3-trimethoxy-5-(methylthio)-benzene | 53% |
| 8 | diphenyl ether | p-(methylthio)phenyl phenyl ether | 49% |
| | | bis[p-(methylthio)phenyl] ether | 9% |
| 9 | anisole | p-(methylthio)methoxybenzene | 82% |

Example 4 illustrates the facility with which para-substitution of phenolic compounds can be effected in the practice of this invention.

Example 5 illustrates the facility with which ortho-substitution of phenolic compounds in which the para position is sterically hindered can be effected in the practice of this invention.

Generally speaking, more forcing conditions (higher temperature, longer reaction period, etc.) are required with aromatic compounds devoid of activating functionality in the molecule. Thus, aromatic compounds having activating functionality, i.e., electron-donating functionality, are preferred reactants in the process.

This invention is susceptible to considerable variation in its practice. Thus the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A process which comprises generating an organothiating agent from an organic disulfide in which the organic groups are (i) primary or secondary organic groups and are (ii) free of nonaromatic unsaturation, via electrolysis in liquid sulfur dioxide.

2. A process according to claim 1 wherein the organic disulfide used is a hydrocarbyl disulfide.

3. A process according to claim 2 wherein the hydrocarbyl disulfide used is a primary aliphatic disulfide.

4. A process according to claim 3 wherein the primary aliphatic disulfide used is dimethyl disulfide.

5. A process according to any of claims 1, 2, 3, or 4 wherein (i) the electrolysis is carried out with the potential in the range of from about 0.5V less than the oxidation potential of the disulfide used, to about 1.0V more than the oxidation potential of the disulfide used, either with constant current or with constant potential, and (ii) wherein the current passed is in the range of from about 90000 Coulombs to about 205000 Coulombs per mole of the disulfide used.

6. A process according to any of claims 1, 2, 3, or 4 wherein the temperature of the liquid sulfur dioxide is maintained in the range of from about −60° C. to about −10° C. at atmospheric pressure.

7. A process which comprises:

A) generating an organothiating agent solution from an organic disulfide in which the organic groups are (i) primary or secondary organic groups and are (ii) free of nonaromatic unsaturation via electrolysis in liquid sulfur dioxide; and B) contacting at least a portion of the solution from said electrolysis with an organothiatable aromatic compound in order to organothiate the aromatic compound.

8. A process according to claim 7 wherein the organic disulfide used is a hydrocarbyl disulfide.

9. A process according to claim 8 wherein the hydrocarbyl disulfide used is a primary aliphatic disulfide.

10. A process according to claim 9 wherein the primary aliphatic disulfide used is dimethyl disulfide.

11. A process according to any of claims 7, 8, 9, or 10 wherein (i) the electrolysis is carried out with the potential in the range of form about 0.5V less than the oxidation potential of the disulfide used, to about 1.0V more than the oxidation potential of the disulfide used, either with constant current or with constant potential, and (ii) wherein the current passed is in the range of from about 90000 Coulombs to about 205000 Coulombs per mole of the disulfide used.

12. A process according to any of claims 7, 8, 9, or 10 wherein in A) and in B) the temperature is, independently, in the range of from about −60° C. to about −10° C. at atmospheric pressure.

13. A process according to any of claims 7, 8, 9, or 10 wherein the organothiatable aromatic compound used is at least one hydroxyaromatic compound having at least one replaceable hydrogen atom and at least one hydroxyl group on the same aromatic ring.

14. A process according to any of claims 7, 8, 9, or 10 wherein the organothiatable aromatic compound used is phenol or a substituted phenol having at least one replaceable hydrogen atom and a hydroxyl group on the aromatic ring.

15. A process according to any of claims 7, 8, 9, or 10 wherein (i) the electrolysis is carried out with the potential in the range of form about 0.5V less than the oxidation potential of the disulfide used, to about 1.0V more than the oxidation potential of the disulfide used, either with constant current or with constant potential; (ii) wherein the current passed is in the range of from about 90000 Coulombs to about 205000 Coulombs per mole of the disulfide used; and (iii) wherein the organothiatable aromatic compound used is at least one aromatic hydrocarbon having at least one replaceable hydrogen atom on an aromatic ring, or at least one aromatic oxygen-containing compound, or at least one aromatic sulfur-containing compound.

16. A process according to any of claims 7, 8, 9, or 10 wherein (i) the electrolysis is carried out with the potential in the range of from about 0.5V less than the oxidation potential of the disulfide used, to about 1.0V more than the oxidation potential of the disulfide used, either with constant current or with constant potential; (ii) wherein the current passed is in the range of from about 90000 Coulombs to about 205000 Coulombs per mole of the disulfide used; and (iii) wherein the organothiatable aromatic compound used is at least one hydroxyaromatic compound having at least one replaceable hydrogen atom and at least one hydroxyl group on the same aromatic ring.

17. A process according to any of claims 7, 8, 9, or 10 wherein (i) the electrolysis is carried out with the potential in the range of from about 0.5V less than the oxidation potential of the disulfide used, to about 1.0V more than the oxidation potential of the disulfide used, either with constant current or with constant potential; (ii) wherein the current passed is in the range of from about 90000 Coulombs to about 205000 Coulombs per mole of the disulfide used; and (iii) wherein the organothiatable aromatic compound used is phenol or a substituted phenol having at least one replaceable hydrogen atom and a hydroxyl group on the aromatic ring.

18. A process according to any of claims 7, 8, 9, or 10 wherein the organothiatable aromatic compound used is at least one aromatic hydrocarbon having at least one replaceable hydrogen atom on an aromatic ring.

19. A process according to any of claims 7, 8, 9, or 10 wherein the organothiatable aromatic compound used is at least one aromatic compound having at least one replaceable hydrogen atom on an aromatic ring and having electron-donating functionality in the molecule, activating said aromatic ring.

* * * * *